US012060191B2

(12) United States Patent
Bassissi et al.

(10) Patent No.: US 12,060,191 B2
(45) Date of Patent: Aug. 13, 2024

(54) PACKAGING MACHINE AND METHOD FOR PRODUCING SEALED PACKAGES

(71) Applicant: TETRA LAVAL HOLDINGS & FINANCE S.A., Pully (CH)

(72) Inventors: Fabio Bassissi, Modena (IT); Stefano Costa, Casalmaggiore (IT); Claudio Ferrari, Fiorano Modenese (IT); Roberto De-Pietri-Tonelli, Colombaro di Formigine (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 351 days.

(21) Appl. No.: 17/432,147

(22) PCT Filed: Apr. 10, 2020

(86) PCT No.: PCT/EP2020/060313
§ 371 (c)(1),
(2) Date: Aug. 19, 2021

(87) PCT Pub. No.: WO2020/212279
PCT Pub. Date: Oct. 22, 2020

(65) Prior Publication Data

US 2022/0185515 A1 Jun. 16, 2022

(30) Foreign Application Priority Data

Apr. 19, 2019 (EP) ..... 19170358

(51) Int. Cl.
*B65B 9/207* (2012.01)
*B65B 9/12* (2006.01)
(Continued)

(52) U.S. Cl.
CPC ..... *B65B 9/12* (2013.01); *B65B 9/2014* (2013.01); *B65B 41/16* (2013.01); *B65B 51/26* (2013.01);
(Continued)

(58) Field of Classification Search
CPC ..... B65B 9/12; B65B 9/2014; B65B 9/207; B65B 9/213; B65B 41/16; B65B 51/26;
(Continued)

(56) References Cited

U.S. PATENT DOCUMENTS 3,116,032 A * 12/1963 Roberts ..... B65B 41/16 242/421.7
3,240,411 A * 3/1966 Zarleng ..... H02P 5/48 226/118.4
(Continued)

FOREIGN PATENT DOCUMENTS

CN 102762471 A 10/2012
CN 109573130 A 4/2019
(Continued)

OTHER PUBLICATIONS

Office Action (The First Office Action) issued Jan. 28, 2023, by the State Intellectual Property Office of People's Republic of China in corresponding Chinese Patent Application No. 202080029932.2 and an English translation of the Office Action. (20 pages).
(Continued)

*Primary Examiner* — Stephen F. Gerrity
(74) *Attorney, Agent, or Firm* — BUCHANAN INGERSOLL & ROONEY PC

(57) ABSTRACT

A packaging machine includes a conveying device for advancing a packaging material web at least to a tube forming station at which the web is formed into a tube and for advancing the tube to a tube forming and sealing device to form and longitudinally seal the tube, a tensioning device
(Continued)

to control tension of the web and/or of the tube and a control unit to control operation of the packaging machine. The tensioning device has at least one tensioning assembly having at least first and second drive rollers, a first drive motor connected to the first drive roller to rotate the first drive roller and a second drive motor connected to the second drive roller to rotate the second drive roller. The control unit controls the first and second drive motors such that a free loop of the web expands and/or advances between the first and second drive rollers.

16 Claims, 5 Drawing Sheets

(51) Int. Cl.

| | |
|---|---|
| ***B65B 9/20*** | (2012.01) |
| ***B65B 41/16*** | (2006.01) |
| ***B65B 51/26*** | (2006.01) |
| ***B65B 55/04*** | (2006.01) |
| ***B65B 57/14*** | (2006.01) |
| ***B65H 20/32*** | (2006.01) |
| ***B65H 23/188*** | (2006.01) |
| ***B65H 23/192*** | (2006.01) |
| *B65B 9/213* | (2012.01) |
| *B65B 55/08* | (2006.01) |
| *B65B 55/10* | (2006.01) |
| *B65B 61/00* | (2006.01) |

(52) U.S. Cl.
CPC ..... *B65B 55/04* (2013.01); *B65B 57/145* (2013.01); *B65H 20/32* (2013.01); *B65H 23/1888* (2013.01); *B65H 23/192* (2013.01); *B65B 9/207* (2013.01); *B65B 9/213* (2013.01); *B65B 55/08* (2013.01); *B65B 55/103* (2013.01); *B65B 61/00* (2013.01); *B65H 2408/214* (2013.01); *B65H 2511/112* (2013.01); *B65H 2701/1944* (2013.01)

(58) Field of Classification Search
CPC ..... B65B 55/04; B65B 55/08; B65B 55/103; B65B 57/145; B65B 61/00; B65H 20/32; B65H 23/1888; B65H 23/192; B65H 2408/214; B65H 2511/112; B65H 2701/1944
USPC ..... 53/451, 551
See application file for complete search history.

(56) References Cited

U.S. PATENT DOCUMENTS

| | | | | | |
|---|---|---|---|---|---|
| 3,940,042 | A * | 2/1976 | Keck | B65H 20/24 | 226/111 |
| 4,350,275 | A | 9/1982 | Kuhn | | |
| 4,719,855 | A * | 1/1988 | Cannon et al. | B65H 20/32 | 101/223 |
| 4,800,707 | A * | 1/1989 | Rabus | B65B 9/213 | 53/64 |
| 5,014,498 | A | 5/1991 | McMahon | | |
| 5,480,085 | A * | 1/1996 | Smithe et al. | B26D 5/30 | 226/118.3 |
| 5,485,712 | A * | 1/1996 | Cherney et al. | B65B 9/213 | 53/436 |
| 5,707,024 | A * | 1/1998 | Mellquist et al. | B65H 20/24 | 242/418.1 |
| 6,067,778 | A * | 5/2000 | Yamamoto et al. | B65B 41/16 | 53/64 |
| 2008/0106025 | A1* | 5/2008 | Padros et al. | B65H 23/044 | 270/52.09 |
| 2011/0036062 | A1* | 2/2011 | Borsari et al. | B65B 51/26 | 53/548 |
| 2013/0020427 | A1 | 1/2013 | Gelli et al. | | |
| 2014/0053745 | A1* | 2/2014 | Dawley et al. | B65H 23/1888 | 101/228 |
| 2014/0352257 | A1 | 12/2014 | Voss et al. | | |
| 2022/0194639 | A1* | 6/2022 | Melandri et al. | B65H 20/24 | |

FOREIGN PATENT DOCUMENTS

| | | | | |
|---|---|---|---|---|
| DE | 4031964 | A1 * | 4/1992 | B41F 13/0045 |
| DE | 102010029359 | A1 | 12/2011 | |
| DE | 102011075431 | A1 * | 11/2012 | B65B 41/18 |
| DE | 10 2013 105 551 | A1 | 12/2014 | |
| EP | 3461749 | A2 | 4/2019 | |
| GB | 2249782 | A * | 5/1992 | B65H 20/24 |
| JP | S63-044401 | A | 2/1988 | |
| JP | H04-128105 | A | 4/1992 | |
| JP | H07304546 | A * | 11/1995 | B65H 20/34 |
| JP | H11-043248 | A | 2/1999 | |
| JP | 2000-190908 | A | 7/2000 | |
| JP | 2002-104308 | A | 4/2002 | |
| JP | 2004-189403 | A | 7/2004 | |
| WO | 9410038 | A1 | 5/1994 | |
| WO | 2011/147639 | A1 | 12/2011 | |
| WO | 2016139056 | A1 | 9/2016 | |

OTHER PUBLICATIONS

International Search Report (PCT/ISA/210) and Written Opinion (PCT/ISA/237) mailed on Jun. 5, 2020, by the European Patent Office as the International Searching Authority for International Application No. PCT/EP2020/060313.

* cited by examiner

PACKAGING MACHINE AND METHOD FOR PRODUCING SEALED PACKAGES

TECHNICAL FIELD

The present invention relates to a packaging machine for producing sealed packages of a pourable product, in particular a pourable food product.

The present invention also relates to a method for producing sealed packages of a pourable product, in particular a pourable food product.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by sealing and folding laminated strip packaging material. The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material (an oxygen-barrier layer), e.g. an aluminum foil, which is superimposed on a layer of heat-seal plastic material, and is in turn covered with another layer of heat-seal plastic material forming the inner face of the package eventually contacting the food product.

Packages of this sort are normally produced on fully automatic packaging machines, which advance a web of packaging material through a sterilization apparatus for sterilizing the web of packaging material at a sterilization station and to an isolation chamber (a closed and sterile environment) in which the sterilized web of packaging material is maintained and advanced. During advancement of the web of packaging material through the isolation chamber, the web of packaging material is folded and sealed longitudinally at a tube forming station to form a tube having a longitudinal seam portion, the tube being further fed along a vertical advancing direction.

In order to complete the forming operations, the tube is filled with a sterilized or sterile-processed pourable product, in particular a pourable food product, and is transversally sealed and subsequently cut along equally spaced transversal cross sections within a package forming unit of the packaging machine during advancement along the vertical advancing direction.

Pillow packages are so obtained within the packaging machine, each pillow package having a longitudinal sealing band, a top transversal sealing band and a bottom transversal sealing band.

A typical packaging machine comprises a conveying device for advancing the web of packaging material along a web advancement path and a tube formed from the web of packaging material along a tube advancement path, the sterilization apparatus for sterilizing the web of packaging material prior to its formation into the tube, a tube forming and sealing device at least partially arranged within an isolation chamber and being configured to form the tube from the advancing web of packaging material and to longitudinally seal the tube, a filling device for filling the tube with the pourable product and a package forming unit adapted to form, transversally seal and cut the single packages from the tube of packaging material.

A typical packaging machine also comprises a tensioning device configured to control the tension of the web of packaging material and/or of the tube.

In particular, the tensioning device comprises at least one tensioning assembly for controlling the tension of a portion of the web of packaging material and/or of the tube immediately downstream of the tensioning assembly itself.

In particular, it is known to arrange one tensioning assembly between the sterilization station and the tube forming station for controlling at least the tension of the tube.

A typical tensioning assembly comprises at least one first roller rotatable around a first rotation axis, one first counter-roller adjacent to the first roller, one second roller rotatable around a second rotation axis and arranged downstream of the first roller, one second counter-roller adjacent to the second roller and a drive motor associated to the second roller for actuating rotation of the second roller around the second rotation axis.

A typical tensioning assembly further comprises a pendulum roller interposed between the first roller and the second roller and configured to tension the portion of the web of packaging material expanding between the first roller and the second roller.

It should be noted that the operation of the package forming unit is cyclic leading to cyclic forces and variations in the advancement speed of the tube.

Therefore, the tensioning assembly arranged between the tube forming station and the sterilization station is controlled such that the drive motor controls a constant rotation speed of the second roller, which corresponds to the average advancement speed of the tube and the operation of the pendulum roller compensates for the difference between the web advancement speed resulting from the rotation of the second roller and the advancement speed of the tube.

The Applicant has found out that while the control of the tension of the web of packaging material and/or of the tube is done sufficiently well allowing for a reliable production of the packages, the tension of the web of packaging material and/or of the tube partially varies in an uncontrolled manner.

Therefore, the desire is felt to improve the known tensioning devices and the method of producing packages so as to improve preciseness and/or reliability of the tension control.

DISCLOSURE OF INVENTION

It is therefore an object of the present invention to provide a packaging machine to overcome, in a straightforward manner, at least one of the aforementioned drawbacks.

In particular, it is an object of the present invention to provide a packaging machine coming along with an improved tension control.

It is a further object of the present invention to provide a method for producing sealed packages to overcome, in a straightforward manner, at least one of the aforementioned drawbacks.

In particular, it is an object of the present invention to provide a method coming along with an improved tension control.

According to the present invention, there is provided a packaging machine and a method for producing sealed packages according to the independent claims.

Preferred embodiments are claimed in the dependent claims.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
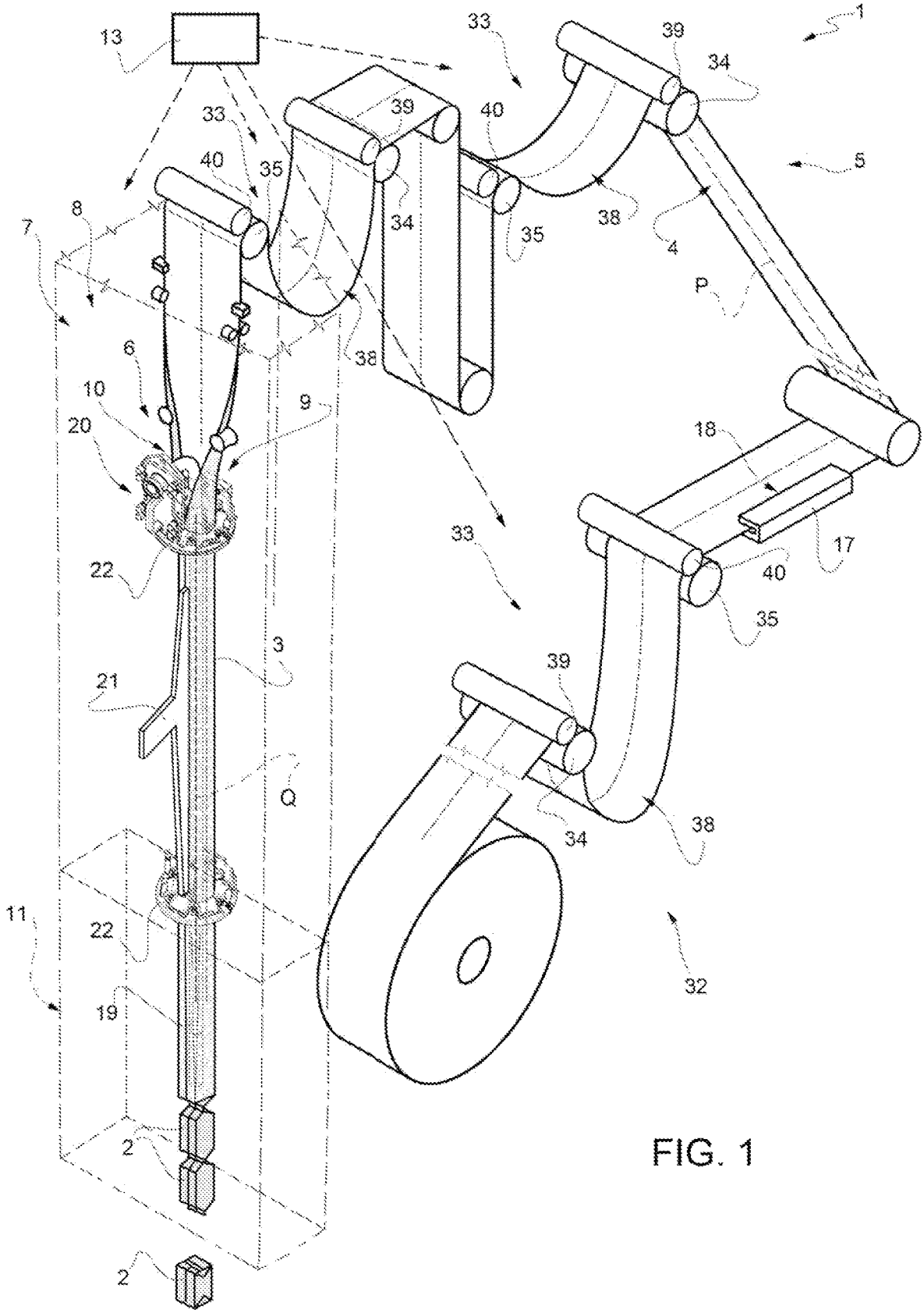
FIG. 1 is a schematic view of a packaging machine according to the present invention, with parts removed for clarity.

Number 1 indicates as a whole a packaging machine for producing sealed packages 2 of a pourable product, in particular a pourable food product such as pasteurized milk, fruit juice, wine, tomato sauce, etc., from a tube 3 of a web 4 of packaging material. In particular, in use, tube 3 extends along a longitudinal axis, preferentially having a vertical orientation.

Web 4 of packaging material has a multilayer structure (not shown), and comprises at least a layer of fibrous material, such as e.g. a paper or cardboard layer, and at least two layers of heat-seal plastic material, e.g. polyethylene, interposing the layer of fibrous material in between one another. One of these two layers of heat-seal plastic material defines the inner face of package 2 eventually contacting the pourable product.

Preferably but not necessarily, web 4 also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially but not necessarily, web 4 also comprises a further layer of heat-seal plastic material being interposed between the layer of gas- and light-barrier material and the layer of fibrous material.

According to a preferred non-limiting embodiment, web 4 comprises a first face and a second face, in particular the first face being the face of web 4 forming the inner face of the formed package 2 eventually contacting the filled pourable food product.

According to a preferred non-limiting embodiment, a typical package 2 obtained by packaging machine 1 comprises a longitudinal seam portion and a pair of transversal sealing bands, in particular a transversal top sealing band and a transversal bottom sealing band.

With particular reference to FIG. 1, packaging machine 1 is configured to advance web 4 along a web advancement path P, preferably to sterilize web 4 during advancement along path P, to form and longitudinally seal tube 3 from web 4, preferably to fill tube 3 with the pourable product and, preferentially to form single packages 2 from the filled tube 3.

Figure 2:
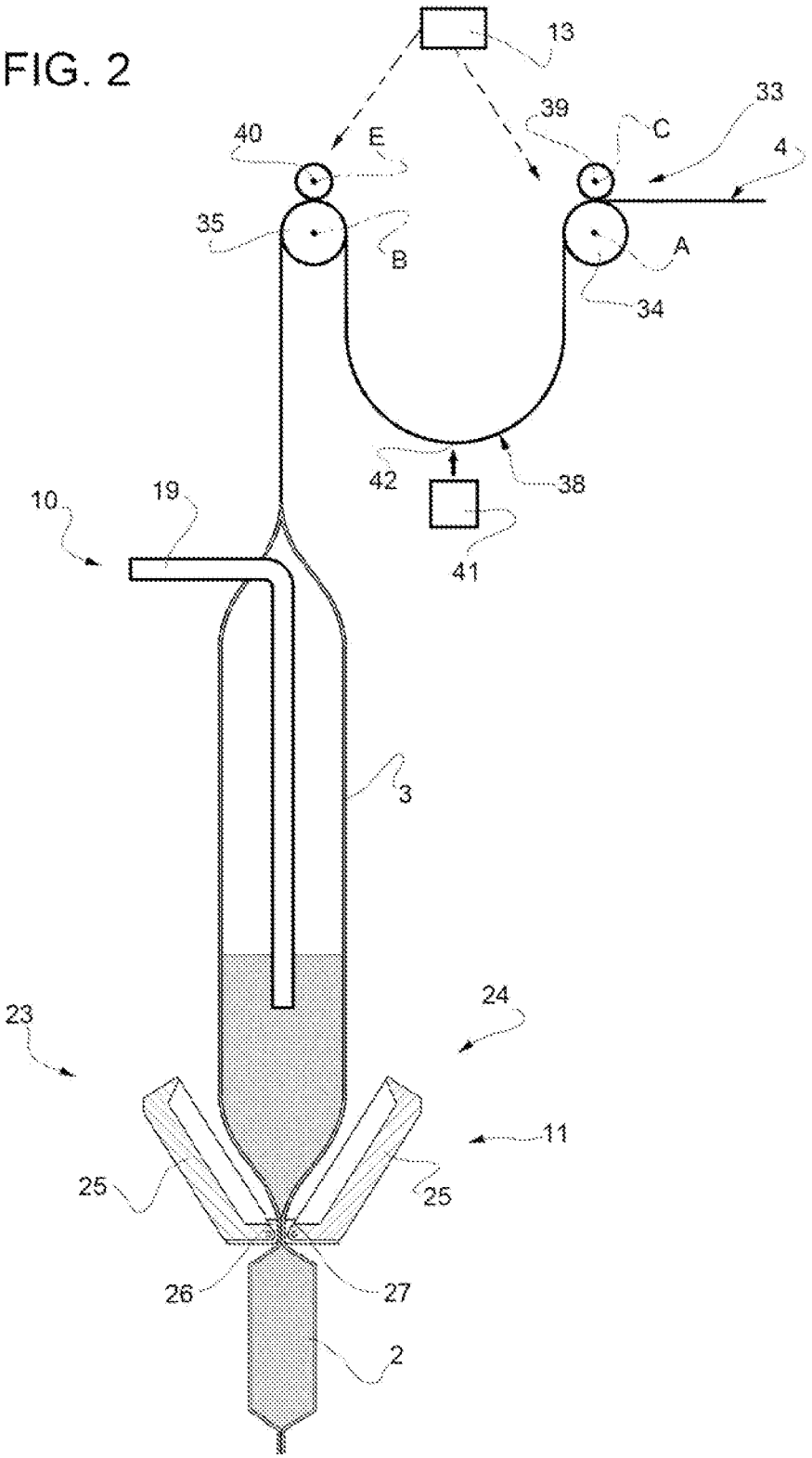
FIG. 2 is a schematic view of portions of the packaging machines of FIG. 1, with parts removed for clarity.

With particular reference to FIGS. 1 and 2, packaging machine 1 comprises:

- a conveying device 5 configured to advance web 4 along a web advancement path P at least to a tube forming station 6 at which web 4 is formed, in use, into tube 3 and for advancing tube 3 along a tube advancement path Q;
- an isolation chamber 7 having an inner (sterile) environment 8 and extending along a longitudinal axis, preferentially but not necessarily the longitudinal axis having a vertical orientation;
- a tube forming and sealing device 9 at least partially arranged within isolation chamber 7 and being configured to form and longitudinally seal tube 3 at tube forming station 6, in particular within at least a portion of isolation chamber 7, even more particular within inner environment 8;
- in particular, a filling device 10 for filling tube 3 with the pourable product; and
- in particular, a package forming unit 11 adapted to (configured to) at least form and transversally seal tube 3, preferentially to also transversally cut tube 3, between successive packages 2, in particular during advancement of tube 3 along tube advancement path Q, for forming packages 2 themselves.

According to a preferred non-limiting embodiment, packaging machine 1 further comprises a sterilization apparatus for sterilizing at least a portion of web 4, preferentially at least the first face, even more preferentially the first face and the second face, in particular at a sterilization station arranged upstream of tube forming station 6 along web advancement path P. According to a preferred non-limiting embodiment, packaging machine 1 also comprises a control unit 13 for controlling operation of packaging machine 1 itself.

According to a preferred non-limiting embodiment, packaging machine 1 also comprises a sealing strip application device 17 configured to apply a sealing strip (not specifically shown) of a heat-sealable material, in particular a heat-sealable plastic material, onto at least one lateral edge of web 4, in particular at a strip application station 18 arranged upstream of tube forming station 6, and in particular also the sterilization station, along web advancement path P.

According to a preferred non-limiting embodiment, packaging machine 1 also comprises a magazine unit adapted to host and to provide for web 4 at a host station. In particular, conveying device 5 is configured to advance web 4 from the host station to tube forming station 6.

In particular, package forming unit 11 is arranged downstream of isolation chamber 7 and tube forming and sealing device 9 along path Q.

Preferentially but not necessarily, conveying device 5 is adapted to advance tube 3 and any intermediate of tube 3 in a manner known as such along path Q, in particular from tube forming station 6 through isolation chamber 7, in particular towards and at least partially through package forming unit 11. In particular, with intermediates of tube 3 any configuration of web 4 is meant prior to obtaining the tube structure and after folding of web 4 by tube forming and sealing device 9 has started. In other words, the intermediates of tube 3 are a result of the gradual folding of web 4 so as to obtain tube 3, in particular by overlapping opposite lateral edges of web 4 with one another.

According to a preferred non-limiting embodiment, the sterilization apparatus is configured to sterilize web 4, in particular the first face, even more particular also the second face, by means of physical sterilization such as a sterilization irradiation, in particular an electromagnetic irradiation, even more particular electron beam irradiation.

Alternatively or in addition, the sterilization apparatus could be configured to sterilize web 4, in particular the first face, even more particular also the second face, by means of chemical sterilization, in particular by means of hydrogen peroxide.

According to a preferred non-limiting embodiment, isolation chamber 7 separates inner environment 8 from an outer environment, in particular for allowing to form and to fill tube 3 within a controlled atmosphere. In particular, inner environment 8 contains a sterile gas.

With particular reference to FIGS. 1 and 2, filling device 10 comprises at least a filling pipe 19 being in fluid connection with a pourable product storage tank (not shown and known as such) and partially extending within isolation chamber 7, in particular inner environment 8. In particular, in use, filling pipe 19 is partially placed within tube 3 for feeding the pourable product into the, in use, advancing tube 3.

With particular reference to FIG. 1, tube forming and sealing device 9 comprises at least a tube forming assembly 20 configured to form tube 3 from web 4, in particular by overlapping the respective lateral edges of web 4, and at least a sealing head 21 configured to longitudinally seal tube 3, in particular along the portion of tube 3 obtained by the overlapping of the lateral edges of web 4.

Preferentially but not necessarily, tube forming assembly 20 and sealing head 21 are arranged within isolation chamber 7, in particular within inner environment 8.

Preferentially but not necessarily, tube forming assembly 20 comprises at least a plurality of forming ring assemblies 22, in the particular example shown two, being adapted to fold web 4 gradually into tube 3. In particular, forming ring assemblies 22 are arranged within parallel and spaced apart planes, in particular being orthogonal to the longitudinal axis of isolation chamber 7, even more specifically having a substantially horizontal orientation.

Preferentially but not necessarily, tube forming and sealing device 9 also comprises a pressuring assembly configured to exert a mechanical force on tube 3, in particular for promoting the longitudinal sealing of tube 3. In particular, the pressuring assembly is associated to the forming ring assembly 22 being arranged downstream of the other forming ring assembly 22 along web advancement path P and/or tube advancement path Q.

According to a preferred non-limiting embodiment, package forming unit 11 comprises a plurality of pairs of at least one respective operative assembly 23 (only one shown) and at least one counter-operative assembly 24 (only one shown); and in particular, a conveying unit (not shown and known as such) adapted to advance the respective operative assemblies 23 and the respective counter-operative assemblies 24 of the pairs along respective conveying paths.

Preferentially but not necessarily, each operative assembly 23 is adapted to cooperate, in use, with the respective counter-operative assembly 24 of the respective pair for forming a respective package 2 from tube 3. In particular, each operative assembly 23 and the respective counter-operative assembly 24 are configured to form, to transversally seal and, preferably but not necessarily also to transversally cut, tube 3 for forming packages 2, in particular when, in use, advancing along a respective operative portion of the respective conveying path.

Preferentially but not necessarily, each operative assembly 23 and the respective counter-operative assembly 24 are adapted to cooperate with one another for forming a respective package 2 from tube 3 when advancing along a respective operative portion of the respective conveying path.

Preferentially but not necessarily, each operative assembly 23 and the respective counter-operative assembly 24 are configured to contact tube 3 when advancing along the respective operative portion of the respective conveying path, in particular starting to contact tube 3 at a (fixed) hit position.

Preferentially but not necessarily, each operative assembly 23 and counter-operative assembly 24 comprises:

- a half-shell 25 adapted to contact tube 3 and to at least partially define the shape of packages 2;
- one of a sealing element 26 and a counter-sealing element 27, adapted to transversally seal tube 3 in a known manner between adjacent packages 2; and
- preferably but not necessarily, one of a cutting element (not shown and known as such) and a counter-cutting element (not shown and known as such) for transversally cutting tube 3 between adjacent packages 2 in a manner known as such.

Preferentially but not necessarily, each half-shell 25 is adapted to be controlled between a working position and a rest position by means of a driving assembly (not shown). In particular, each half-shell 25 is adapted to be controlled into the working position with the respective operative assembly 23 or the respective counter-operative assembly 24, in use, advancing along the respective operative portion.

Preferentially but not necessarily, each sealing element 26 and each counter-sealing element 27 is adapted to be controlled between an active sealing position in which sealing element 26 and counter-sealing element 27 are in contact with tube 3 and are adapted to transversally seal in collaboration tube 3 and a rest position in which sealing element 26 and counter-sealing element 27 are detached from tube 3. In particular, each sealing element 26 and each counter-sealing element 27 is adapted to be controlled into the sealing position with the respective operative assembly 23 or the respective counter-operative assembly 24, in use, advancing along the respective operative portion.

Preferentially but not necessarily, each half-shell is configured to be controlled into the respective working position with the respective sealing element 26 and counter-sealing element 27 being controlled into the respective active position.

Preferentially but not necessarily, each operative assembly 23 and each counter-operative assembly 24 in collaboration with the conveying unit are configured to exert a traction force on tube 3 for advancing tube 3 along tube advancement path Q.

Preferentially but not necessarily, operative assemblies 23, counter-operative assemblies 24 and the conveying unit can be considered to form part of conveying device 5.

It should be noted that the forces acting on tube 3 and resulting from the interaction with operative assemblies 23 and counter-operative assemblies 24 depend on the varying steps of the formation of packages 2. The forces acting on tube 3 vary e.g. due to the sealing elements 26 and counter-sealing elements 27 contacting tube 3 when being controlled into the respective active positions and/or when half-shells 25 are controlled into the respective working positions and/or the traction of tube 3 due to the advancement of operative assemblies 23 and counter-operative assemblies 24 along the respective conveying paths.

In particular, during the process of the formation of packages 2 (by means of package forming unit 11) a complex and cyclic behavior of the acting forces is present.

According to a preferred non-limiting embodiment, sealing strip application device 17 comprises:

- a positioning unit (not shown in detail and known as such) adapted to (configured to) position a first longitudinal portion of the sealing strip onto one lateral edge of web 4; and
- a strip sealing unit (not shown in detail and known as such) adapted to seal the first longitudinal portion of the sealing strip to web 4, in particular the lateral edge of web 4.

In particular, tube forming and sealing device 9 is configured to form tube 3 such that the sealing strip applied onto web 4 covers the lateral edge of web 4, which is disposed inside of tube 3 (and, accordingly inside of packages 2). Even more particular, the sealing strip is in contact with a portion of the first face of web 4.

With particular reference to FIGS. 1 and 2, packaging machine 1 also comprises at least one tensioning device 32 configured to control at least the tension of web 4 and/or of tube 3. In particular, tensioning device 32 is configured to locally and selectively control the tension of web 4 and/or of tube 3.

Advantageously, tensioning device 32 comprises at least one tensioning assembly 33, preferentially but not necessarily a plurality of tensioning assemblies 33, configured to control the tension of web 4 and/or of tube 3. In particular, each tensioning assembly 33 is configured to selectively and locally control the tension of a respective downstream portion of web 4 and/or of tube 3 along web advancement path P and/or tube advancement path Q.

In particular, each tensioning assembly 33 is arranged upstream of tube forming station 6 along web advancement path P.

According to a preferred non-limiting embodiment, each tensioning assembly 33 is configured to operate independently from the other tensioning assemblies 33.

Advantageously, control unit 13 is configured to selectively control operation of each tensioning assembly 33. In particular, control unit 13 is configured to control each tensioning assembly 33 independently from the other tensioning assemblies 33.

With particular reference to FIGS. 1 and 2, tensioning device 32 comprises at least:

- one tensioning assembly 33 arranged upstream of tube forming station 6 and/or tube forming and sealing device 9, and in particular downstream of the sterilization station and/or the sterilization device, and being configured to at least control the tension of tube 3 and/or the portion of web 4 extending between the tensioning assembly 33 and tube forming station 6 and/or tube forming and sealing device 9; and/or
- one tensioning assembly 33 arranged upstream of strip application station 18 and/or sealing strip application device 17 along web advancement path P and being configured to control the tension of web 4 at strip application station 18 and/or during, in use, the application of the sealing strip and/or the operation of sealing strip application device 17; and/or
- one tensioning assembly 33 arranged downstream of strip application station 18 and/or sealing strip application device 17 and upstream of the sterilization station and/or the sterilization device along web advancement path P.

With particular reference to FIGS. 1 to 5, each tensioning assembly 33 comprises at least:

- a first drive roller 34 rotatable around a first rotation axis A;
- a second drive roller 35 rotatable around a second rotation axis B;
- a first drive motor, in particular a first servo motor, connected to first drive roller 34 and configured to actuate and/or control rotation of first drive roller 34 around rotation axis A; and
- a second drive motor 37, in particular a servo motor, connected to second drive roller 35 and configured to actuate rotation of second drive roller 35 around rotation axis B.

Figure 3:
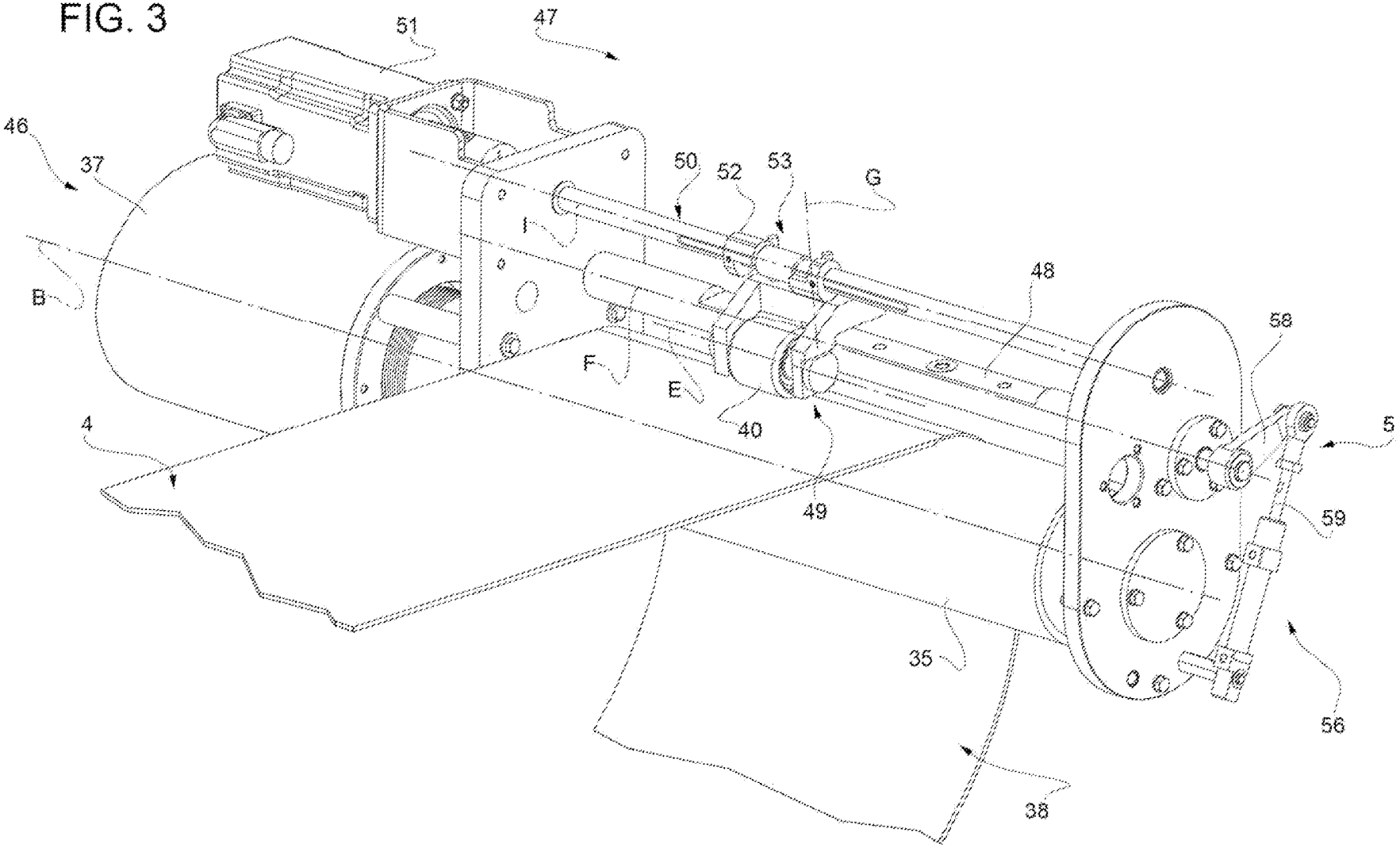
FIG. 3 is a perspective view of a detail of the packaging machine of FIG. 1, with parts removed for clarity.
Figure 5:
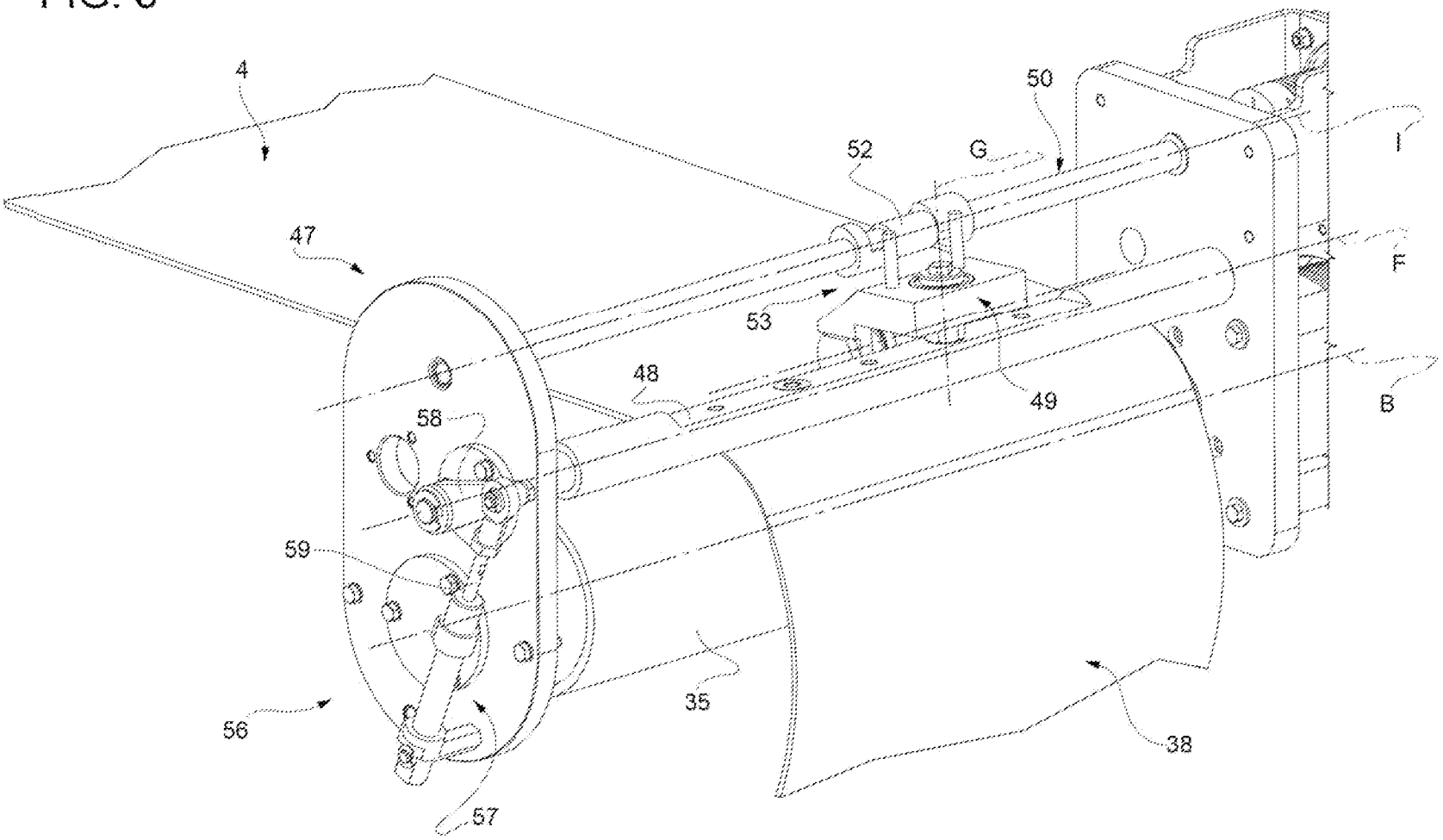
FIG. 5 is a perspective view of the detail of FIG. 3 according to a different perspective, with parts removed for clarity.

It should be noted that FIGS. 3 and 5 show a first portion of each tensioning assembly 33 having the respective second drive roller 35 and the respective second drive motor 37. A second portion of each tensioning assembly 33 having the respective first drive roller 34 and the respective first drive motor is not specifically shown, as the second portion is substantially identical to the first portion.

According to a preferred non-limiting embodiment, the respective first drive roller 34 and the respective second drive roller 35 of each tensioning assembly 33 are spaced apart along web advancement path P, in particular with the respective first drive roller 34 being arranged upstream of the respective second drive roller 35.

Advantageously, control unit 13 is configured to control the respective first drive motor and the respective second drive motor 37 of each tensioning assembly 33 such that a free loop 38 of web 4 expands and/or advances, in use, between the respective first drive roller 34 and the respective second drive roller 35.

With respect to the present invention, the term free loop 38 indicates that the portion of web 4 expanding and/or advancing between the respective first drive rollers 34 and the respective second drive rollers 35 and defining and/or forming free loop 38 is not subjected to any tension; i.e. the portion of web 4 defining and/or forming free loop 38 is exposed to no tensional forces and/or is free of any tensional forces. In other words, each free loop 38 is a tension-free portion of web 4.

According to a preferred non-limiting embodiment, each tensioning assembly 33 further comprises at least:

- a first counter-roller 39 rotatable around a central axis C and being arranged adjacent, in particular peripherally adjacent, even more particular tangential, to first drive roller 34; and
- a second counter-roller 40 rotatable around a central axis E and being arranged adjacent, in particular peripherally adjacent, even more particular tangential, to second drive roller 35.

According to a preferred non-limiting embodiment, and according to the arrangement of the respective first drive roller 34 and the respective second drive roller 35, each first counter-roller 39 is arranged upstream of the respective second counter-roller 40 along web advancement path P.

In particular, in use, web 4 is interposed and/or advances between each first counter-roller 39 and the respective first drive roller 34 and between the respective second counter-roller 40 and the respective second drive roller 35. In other words, in use, during advancement of web 4, web 4 advances between each first drive roller 34 and the respective first counter-roller 39 and each second drive roller 35 and the respective second counter-roller 40.

According to a preferred non-limiting embodiment, control unit 13 is configured to control each second drive motor 37 such that an angular speed and/or an angular acceleration of the respective second drive roller 35 is controlled and/or varied such to control the tension of web 4 and/or of tube 3.

Preferentially but not necessarily, control unit 13 is configured to control each first drive motor such that an angular speed of the respective first drive roller 34 is such to maintain and/or control, in particular the extension of, the respective free loop 38 expanding and/or advancing between the respective first drive roller 34 and the respective second drive roller 35.

In particular, while, in use, the angular speed of each first drive roller 34 substantially controls the extension of the respective free loop 38, the angular speed and/or the angular acceleration of the respective second drive roller 35 substantially controls the tension of web 4 and/or tube 3, in particular a portion of web 4 and/or tube 3 being downstream of the respective second drive roller 35 along web advancement path P.

Preferentially but not necessarily, control unit 13 is configured to selectively control each first drive motor such that the angular speed of the respective first drive roller 34 is substantially constant. In particular, substantially constant means that a possible variation of the angular speed of the respective first drive roller 34 occurs at a lower rate than a variation of the angular speed of the respective second drive roller 35.

According to a preferred non-limiting embodiment, control unit 13 is configured to control each first drive motor, and accordingly the respective second drive roller 35, in dependence of the operation and/or control of the respective second drive motor 37 and/or the angular speed and/or the angular acceleration of the respective second drive roller 35.

According to a preferred non-limiting embodiment, control unit 13 is configured to control each second drive motor 37 such that the angular speed of the respective second drive roller 35 is varied according to at least one pre-defined and/or pre-determined speed profile and/or acceleration profile. In particular, such a speed profile and/or such an acceleration profile and/or a plurality of speed profiles and/or a plurality of acceleration profiles is/are determined and/or defined as a function of the type and/or format of packages 2 and/or the advancement speed of web 4 and/or tube 3 and/or the advancement speeds of operative assemblies 23 and counter-operative assemblies 24 and/or the type of pourable product. Even more particular, each speed profile and/or each acceleration profile is determined and/or measured in a factory set-up.

Preferentially but not necessarily, control unit 13 stores one or more speed profiles and/or acceleration profiles, which, in use, can be chosen for the control of one or more tensioning assemblies 33, in particular at least the respective second drive motor 37.

Preferentially but not necessarily, control unit 13 controls and/or operates each tensioning assembly 33 according to the same speed profile and/or the same acceleration profile and/or different speed profiles and/or acceleration profiles.

According to a preferred non-limiting embodiment, control unit 13 is configured to control each tensioning assembly 33 in dependence on its position along advancement path P and/or its specific function.

According to a preferred non-limiting embodiment, control unit 13 is configured to control the respective second drive motor 37 of the tensioning assembly 33 being interposed between tube forming station 6 and the sterilization station such that the angular speed and/or the angular acceleration of the respective second drive roller 35 is varied and/or controlled as a function of the operation of package forming unit 11 and/or as a function of the package forming cycle and/or the forces acting on tube 3 and/or the operation of filling device 10 and the filling of tube 3. In particular, as mentioned above, the forces acting on tube 3 result from interaction of tube 3 with operative assemblies 23 and counter-operative assemblies 24 and the varying steps of the formation of packages 2, in particular due to the respective sealing elements 26 and counter-sealing elements 27 being controlled into the respective sealing position and/or the respective half-shells 25 being controlled into the working position and/or the advancement of operative assemblies 23 and counter-operative assemblies 24 along the respective operative portions of the conveying paths and/or the introduction of the pourable product through filling pipe 19 into tube 3.

Preferentially but not necessarily, such a (complex) behavior is determined and/or measured prior to operation of packaging machine 1 and/or package forming unit 11 and/or filling device 11 and is coded in the respective speed profile and/or acceleration profile of the respective second drive roller 35.

According to a preferred non-limiting embodiment, each tensioning assembly 33 also comprises at least one sensor element 41 configured to determine and/or measure, in use, the extension and/or level of the respective free loop 38 (i.e. the longitudinal length of the portion of web 4 expanding and/or extending between the respective first drive roller 34 and the respective second drive roller 35.

Preferentially but not necessarily, each sensor element 41 is configured to determine and/or measure the position of an apex 42 of the respective free loop 38 as a measure of the extension and/or level of the respective free loop 38.

According to a preferred non-limiting embodiment, each tensioning assembly 33 further comprises an actuation group 46 configured to modify and/or control the relative orientation between the respective central axis C and the respective rotation axis A and/or to modify and/or control the relative orientation between the respective central axis E and the respective rotation axis B, in particular for (locally) controlling the orientation and/or the advancement direction of web 4.

Preferentially but not necessarily, actuation group 46 is coupled and/or connected to the respective first counter-roller 39 and/or second counter-roller 40 and is configured to control and/or vary the orientation of respectively the corresponding central axis C and the corresponding central axis E with respect to respectively the corresponding rotation axis A and the corresponding rotation axis B for locally controlling the advancement direction and/or the orientation and/or the alignment of web 4. In particular, locally controlling means that the advancement direction and/or the orientation and/or the alignment of web 4 is controlled immediately downstream and/or at the exit of the respective tensioning assembly 33 along advancement path P.

For example, the tensioning assembly 33 being arranged downstream of strip application station 18 is configured to also control (by means of the respective actuation group 46) the advancement direction and/or orientation and/or the alignment of web 4 at strip application station 18 and/or during operation of sealing strip application device 17 and/or during the application of the sealing strip on web 4. In particular, tensioning assembly 33, in particular by means of actuation group 46, is also configured to align web 4 with respect to sealing strip application device 17 such that the sealing strip is correctly applied on the lateral edge of web 4.

Figure 4:
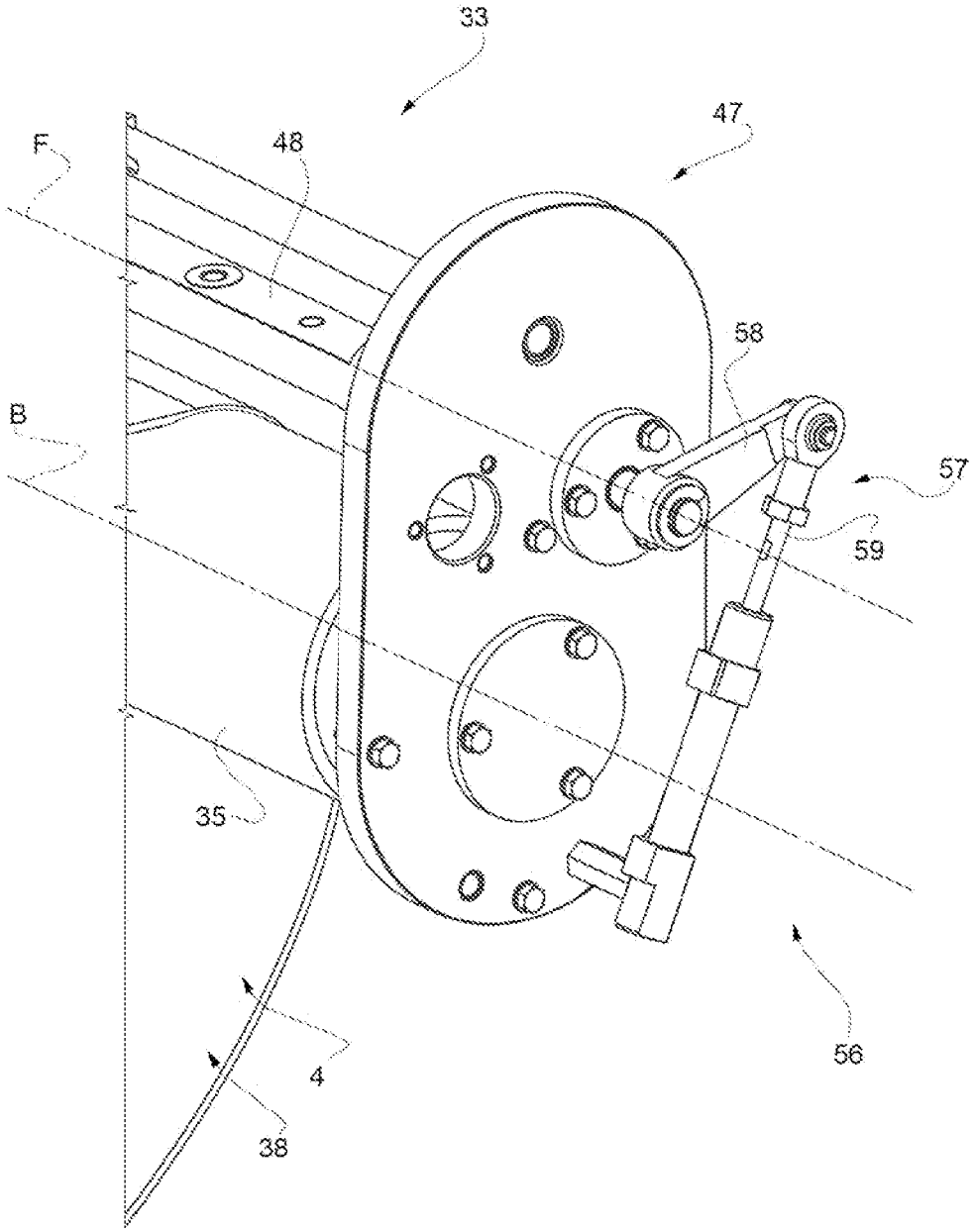
FIG. 4 is an enlarged perspective view of a portion of the detail of FIG. 3, with parts removed for clarity.

With particular reference to FIGS. 3 to 5, each tensioning assembly 33 comprises a support structure 47 carrying and/or supporting the corresponding first drive roller 34 and the corresponding first drive motor and the corresponding second drive roller 35 and the corresponding second drive motor 37.

Preferentially but not necessarily, each support structure 47 also carries and/or supports the respective first counter-roller 39 or second counter-roller 40 and/or the respective actuation group 46.

According to a preferred non-limiting embodiment, each support structure 47 comprises at least one support bar 48 (at least indirectly) carrying the respective first counter-roller 39 or the respective second counter-roller 40 and extending along a central axis F, in particular parallel to respectively the relative rotation axis A and the relative rotation axis B.

Preferentially but not necessarily, each support bar 48 is rotatable around the respective central axis F, in particular for allowing to control the relative distance between respective first counter-roller 39 and the respective first drive roller 34 or between the respective second counter-roller 40 and the respective second drive roller 35.

It should be noted that FIGS. 3 and 5, show the first portion of each tensioning assembly 33; i.e. the support bar 48 shown (at least indirectly) carries second counter-roller 40.

As the construction of the second portion of each tensioning assembly 33 is similar to the construction of the first portion in the following only the first portion is described with reference to FIGS. 3 and 5.

With respect to the construction of the second portion reference is made to the description of the first portion as follows. In particular, when considering the construction of the second portion, it is possible to simply replace the references such that first drive roller 34 takes the place of second drive roller 35 and first counter-roller 39 takes the place of the second counter-roller 40.

In particular, each support structure 47 comprises at least one coupling element 49 pivoted around a pivot axis G on support bar 48 and being connected to and directly carrying the respective first counter-roller 39 or the respective second counter-roller 40.

According to a preferred non-limiting embodiment, each actuation group 46 is configured to control the angular position of the respective coupling element 49 around the respective pivot axis G for controlling the relative position of central axis C with respect to the respective rotation axis A or of central axis E with respect to the respective rotation axis B.

Preferentially but not necessarily, each actuation group 46 comprises at least:

- a control bar 50 rotatable around a respective rotation axis I, in particular being parallel to the respective central axis F, and being configured to interact with the respective coupling element 49; and
- an electrical motor 51 configured to control the angular position of control bar 50 around rotation axis I for controlling the angular position of coupling element 49 around pivot axis G.

In particular, in use, upon a modification of the angular position of the respective control bar 50 around the respective rotation axis I, the respective coupling element 49 pivots around the respective pivot axis G, which again leads to a modification of the orientation of the respective central axis C or the respective central axis E.

Preferentially but not necessarily, each control bar 50 comprises an interaction portion 52, in particular in the form of a cam, configured to interact with an interaction member 53, in particular defining a cam follower, of the respective coupling element 49 for coupling the angular position of the respective control bar 50 to the angular position of the respective coupling element 49.

According to a preferred non-limiting embodiment, each tensioning assembly 33 also comprises at least one actuation assembly 56 configured to control the angular position of at least one respective support bar 48 around the respective central axis F for approaching or withdrawing the respective first counter-roller 39 to or from the respective first drive roller 34 or for approaching or withdrawing the respective second counter-roller 40 to or from the respective second drive roller 35.

According to the non-limiting embodiment shown, each actuation assembly 56 comprises at least one linear actuator 57 and at least one bar element 58 connected to linear actuator 57 and to the respective support bar 48.

Preferentially but not necessarily, each bar element 58 is transversal to the respective support bar 48 and to a piston 59 of the respective linear actuator 57.

According to an alternative embodiment not shown, each actuation assembly 57 could comprise at least one motor, e.g. a stepper motor, connected to the respective support bar 48 and configured to control the angular position of the respective support bar 48.

In use, packaging machine 1 forms packages 2 filled with the pourable product.

In more detail, the main production cycle comprises at least the following steps:

- advancing web 4 along advancement path P;
- folding web 4, in particular within isolation chamber 7, into tube 3 at tube forming station 6;
- advancing tube 3 along tube advancement path Q, in particular towards and at least partially through package forming unit 11; and
- controlling the tension of web 4 and/or of tube 3 by means of tensioning device 32.

Preferentially but not necessarily, the method also comprises the steps of:

- longitudinally sealing tube 3, in particular within isolation chamber 7; and/or
- filling tube 3 with the pourable product; and/or
- forming single packages 2 from tube 3 by forming tube 3, transversally sealing tube 3 between successive packages 2 and, in particular transversally cutting tube 3 between successive packages 2, for obtaining single packages 2 during advancement of tube 3 along tube advancement path Q; and/or
- sterilizing web 4 at sterilization station 8; and/or
- applying at least one sealing strip onto one lateral edge of web 4 at strip application station 18; and/or
- controlling and/or modifying the orientation of web 4 during which web 4 is, in particular selectively and locally, oriented and/or aligned.

According to a preferred non-limiting embodiment, during the step of advancing web 4, conveying device 5 advances web 4 along web advancement path P.

According to a preferred non-limiting embodiment, during the step of folding tube 3, tube forming and sealing device 9 gradually overlaps the opposite lateral edges of web 4 with one another so as to form the longitudinal seam portion.

According to a preferred non-limiting embodiment, during the step of longitudinally sealing tube 3, tube forming and sealing device 9 seals the longitudinal seam portion by directing heat onto the longitudinal seam portion.

According to a preferred non-limiting embodiment, during the step of advancing tube 3, conveying device 5 advances tube 3 (and any intermediates of tube 3), in particular through isolation chamber 7, along path Q into and partially through package forming unit 11.

According to a preferred non-limiting embodiment, during the step of filling tube 3, filling device 10 fills the pourable product into the longitudinally sealed tube 3. In particular, the pourable product is directed into tube 3 through filling pipe 19.

According to a preferred non-limiting embodiment, during the step of sterilizing web 4, at least the first face, in particular also the second face, of web 4 is/are sterilized.

Preferentially but not necessarily, during the step of sterilizing web 4 a sterilizing irradiation, in particular electromagnetic irradiation, even more particular electron beam irradiation, is directed onto at least the first face, preferentially also onto the second face, of web 4.

According to a preferred non-limiting embodiment, the step of sterilizing is executed prior to the step of folding.

According to a preferred non-limiting embodiment, during the step of applying at least one sealing strip, sealing strip application device 17 applies the sealing strip onto one lateral edge of web 4.

According to a preferred non-limiting embodiment, during the step of forming single packages 2, package forming unit 11 forms and transversally seals tube 3 between successive packages 2 and, preferentially also transversally cuts tube 3 between successive packages 2.

Preferentially but not necessarily, during the step of forming single packages 2, operative assemblies 23 and counter-operative assemblies 24 advance along the respective conveying paths and cyclically form and transversally seal, in particular also transversally cut, tube 3 for obtaining packages 2. In particular, sealing elements 26 and counter-sealing elements 27 move from the respective rest position to the respective sealing position for transversally sealing tube 3 between successive packages 2 and half-shells 25 move from the respective rest positions to the respective working positions for forming tube 3.

According to a preferred non-limiting embodiment, during the step of controlling the tension, control unit 13 controls each tensioning assembly 33 independently from the other ones.

According to a preferred non-limiting embodiment, during the step of controlling the tension, the tensioning assembly 33 being interposed between tube forming station and the sterilization station controls at least the tension and/or the tensional profile of tube 3.

According to a preferred non-limiting embodiment, during the step of controlling the tension, the tensioning assembly 33 being arranged upstream of strip application station 18 along web advancement path P controls the tension of web 4 at strip application station 18 and/or during operation of sealing strip application device 17 and/or during the step of applying the sealing strip.

According to a preferred non-limiting embodiment, during the step of controlling the tension, each first drive roller 34 and the respective second drive roller 35 rotate around respectively the relative rotation axis A and the relative rotation axis B such that the respective free loop 38 expands between and/or advances between the respective first drive roller 34 and the respective second drive roller 35.

Preferentially but not necessarily, during the step of controlling the tension, control unit 13 selectively and independently controls each first drive motor and the respective second drive motor 37 for controlling rotation of respectively the respective first drive roller 34 and the respective second drive roller 35.

Preferentially but not necessarily, the angular speed and/or the angular acceleration of each second drive roller 35 is controlled and/or varied such to control the tension of web 4 and/or of tube 3.

Preferentially but not necessarily, the angular speed and/or the angular acceleration of each second drive roller 35 is selectively varied according to respectively the pre-defined and/or pre-determined speed profile and/or acceleration profile. In particular, the speed profile and/or the acceleration profile applied may vary from one second drive roller 35 to another second drive roller 35.

According to a preferred non-limiting embodiment, during the step of controlling the tension, the angular speed and/or the angular acceleration of the respective second drive roller 35 of the tensioning assembly 33 being interposed between tube forming station 6 and the sterilization station is varied and/or controlled as a function of the operation of package forming unit 11 and/or filling device 10 and/or the type and/or format of packages 2. In particular, in this way, the tension of tube 3 is controlled.

According to a preferred non-limiting embodiment, during the step of controlling the tension, the angular speed of each first drive roller 34 is such to maintain the respective free loop 38 expanding and/or advancing between the respective first drive roller 34 and the respective second drive roller 35. In particular, the angular speed of each first drive roller 34 may differ from the angular speed of the other first drive rollers 34.

Preferentially but not necessarily, the angular speed of each first drive roller 34 is substantially constant.

According to a preferred non-limiting embodiment, the step of controlling and/or modifying comprises the sub-step of controlling and/or modifying the relative orientation between at least one central axis C and the respective rotation axis A and/or the relative orientation between at least one central axis E and the respective rotation axis B, in particular by means of the respective actuation group 46.

Preferentially but not necessarily, during the sub-step of controlling and/or modifying, the orientation of at least one central axis E is controlled and/or modified with respect to the respective rotation axis B for controlling an advancement direction and/or the orientation of web 4, in particular by means of the respective actuation group 46.

Preferentially but not necessarily, during the sub-step of controlling and/or modifying, the angular position of the respective control bar 50 is controlled and/or modified by the respective electrical motor 51 for pivoting the respective coupling element 49 around the respective pivot axis G for controlling and/or modifying the orientation of the respective first counter-roller 39 or the respective second counter-roller 40.

According to a preferred non-limiting embodiment, the step of controlling and/or modifying comprises the sub-step of modifying the relative distance between the respective first counter-roller 39 and the respective first drive roller 34 or between the respective second counter-roller 40 and the respective second drive roller by means of operation of the respective actuation assembly 56.

The advantages of packaging machine 1 according to the present invention will be clear from the foregoing description.

In particular, by tensioning device 32 having at least one tensioning assembly 33 the control of the tension of web 4 and/or tube 3 is improved, even more particular the control is more precise. This is achieved by each tensioning assembly 33 having two driven rollers, namely having the respective first drive roller 34 and the respective second drive roller 35 being each coupled to a respective drive motor, namely the first drive motor and the second drive motor 37, and the presence of a non-tensioned portion of web 4, namely free loop 38, advancing, in use, between the respective first drive roller 34 and the respective second drive roller 35.

A further advantage resides in controlling at least one second drive roller 35 according to a pre-defined and/or pre-determined speed profile and/or acceleration profile.

An even further advantage resides in the possibility to control the alignment and/or orientation and/or the advancement direction of web 4 by controlling the relative orientation between at least one first drive roller 34 and the respective first counter-roller 39 and/or at least one second drive roller 35 and the respective second counter-roller 40.

Clearly, changes may be made to packaging machine 1 and the method as described herein without, however, departing from the scope of protection as defined in the accompanying claims.

The invention claimed is:

1. A packaging machine for producing sealed packages of a pourable product from a web of packaging material;

the packaging machine comprises:

a conveying device for advancing the web of packaging material along a web advancement path at least to a tube forming station at which the web of packaging material is formed, in use, into a tube and for advancing the tube along a tube advancement path;

a tube forming and sealing device configured to form the tube at the tube forming station and to longitudinally seal the tube;

a tensioning device configured to control the tension of the web of packaging material and/or of the tube; and a control unit configured to control operation of packaging machine;

wherein the tensioning device comprises at least one tensioning assembly arranged upstream of the tube forming station along the web advancement path and having at least:

a first drive roller rotatable around a first rotation axis;

a second drive roller rotatable around a second rotation axis;

a first drive motor connected to the first drive roller and configured to actuate rotation of the first drive roller around the first rotation axis; and a second drive motor connected to the second drive roller and configured to actuate rotation of the second drive roller around the second rotation axis;

wherein the control unit is configured to control the first drive motor and the second drive motor such that a free loop of the web of packaging material expands and/or advances, in use, between the first drive roller and the second drive roller;

wherein the first drive roller is arranged upstream of the second drive roller along the web advancement path;

wherein the control unit is configured to control the second drive motor such that an angular speed and/or an angular acceleration of the second drive roller is controlled and/or varied such to control the tension of the web of packaging material and/or of the tube; and wherein the control unit is configured to control the second drive motor such that the angular speed and/or the angular acceleration of the second drive roller is varied according to respectively a pre-defined and/or pre-determined speed profile and/or acceleration profile.

2. Packaging machine according to claim 1, wherein the control unit is configured to control the first drive motor such that an angular speed of the first drive roller is such to maintain, in use, the free loop of the web of packaging material.

3. Packaging machine according to claim 2, wherein the control unit is configured to control the first drive motor such that the angular speed of the first drive roller is substantially constant.

4. Packaging machine according to claim 1, and further comprising a filling device configured to fill the tube with the pourable product and a package forming unit adapted to at least form and transversally seal the tube during, in use, advancement of the tube along the tube advancement path;

wherein the control unit is configured to control the second drive motor such that the angular speed and/or the angular acceleration of the second drive roller is varied and/or controlled as a function of the operation of the package forming unit and/or the filling device and/or the type and/or format of the packages.

5. Packaging machine according to claim 1, and further comprising a sterilization apparatus configured to sterilize the web of packaging material at a sterilization station upstream of the tube forming station along the web advancement path;

wherein the tensioning assembly is interposed between the sterilization station and the tube forming station;

wherein the first drive roller and the second drive roller is operated such to control at least the tension of the tube.

6. Packaging machine according to claim 1, and further comprising a sealing strip application device configured to apply at least one sealing strip onto one lateral edge of the web of packaging material at a strip application station;

wherein the tensioning assembly is arranged upstream of the strip application station along the web advancement path and is configured to control the tension of the web of packaging material during application of the sealing strip and/or during operation of the sealing strip application device.

7. Packaging machine according to claim 1, wherein the tensioning assembly also comprises a first counter-roller and a second counter-roller;

wherein the first counter-roller is arranged adjacent to the first drive roller and the second counter-roller is arranged adjacent to the second drive roller;

wherein, in use, the web of packaging material is interposed and/or advances between the first counter-roller and the first drive roller and between the second counter-roller and the second drive roller;

wherein the tensioning assembly comprises an actuation group configured to control and/or modify the relative orientation between a first central axis of the first counter-roller and the first rotation axis of the first drive roller and/or to control and/or modify the relative orientation between a second central axis of the second counter-roller and the second rotation axis of the second drive roller.

8. Packaging machine according to claim 7, wherein the second drive roller and the second counter-roller are arranged downstream of the first drive roller and the first counter-roller along the web advancement path;

wherein the actuation group is coupled and/or connected to the second counter-roller and is configured to control and/or vary the orientation of the second central axis with respect to the second rotation axis for controlling an advancement direction and/or the orientation of the web of packaging material.

9. Method for producing sealed packages of a pourable product from a web of packaging material;

the method comprises at least the steps of:

advancing the web of packaging material along a web advancement path at least to a tube forming station;

forming the web of packaging material into a tube at the tube forming station;

advancing the tube along a tube advancement path;

controlling the tension of the web of packaging material and/or of the tube by means of a tensioning device;

wherein the tensioning device comprises at least one tensioning assembly arranged upstream of the tube forming station along the web advancement path and having at least a first drive roller and a second drive roller;

wherein during the step of controlling the tension, the first drive roller and the second drive roller rotate around respectively a first rotation axis and a second rotation axis such that a free loop of the web of packaging material expands and/or advances between the first drive roller and the second drive roller;

wherein the first drive roller is arranged upstream of the second drive roller along the web advancement path;

wherein during the step of controlling the tension, an angular speed and/or an angular acceleration of the second drive roller is controlled and/or varied such to control the tension of the web of packaging material and/or of the tube; and wherein the angular speed and/or the angular acceleration of the second drive roller is controlled and/or varied according to respectively a pre-defined and/or predetermined speed profile and/or acceleration profile.

10. Method according to claim 9, wherein during the step of controlling the tension, an angular speed of the first drive roller is such to maintain the free loop of the web of packaging material.

11. Method according to claim 10, wherein the angular speed of the first drive roller is substantially constant.

12. Method according to claim 9, and further comprising the steps of:

filling the tube with the pourable product;

forming the packages by at least forming and transversally sealing the tube during advancement of the tube along the tube advancement path;

wherein during the step of controlling the tension, the angular speed of the second drive roller is varied and/or controlled as a function of the steps of filling and/or forming the packages and/or the type and/or format of the packages.

13. Method according to claim 9, and further comprising the step of sterilizing the web of packaging material at a sterilization station upstream of the tube forming station along the web advancement path;

wherein the tensioning assembly is interposed between the sterilization station and the tube forming station;

wherein during the step of controlling the tension, at least the tension of the tube is controlled.

14. Method according to claim 9, and further comprising a step of applying at least one sealing strip onto one lateral edge of the web of packaging material at a strip application station upstream of the tube forming station along the web advancement path;

wherein during the step of controlling the tension, the tensioning assembly controls the tension of the web advancement path during application of the sealing strip.

15. Method according to claim 9, wherein the tensioning assembly also comprises a first counter-roller and a second counter-roller;

wherein the first counter-roller is arranged adjacent to the first drive roller and the second counter-roller is arranged adjacent to the second drive roller;

wherein, during the step of advancing the web of packaging material, the web of packaging material advances between the first counter-roller and the first drive roller and between the second counter-roller and the second drive roller;

wherein the method further comprises the step of controlling and/or modifying the relative orientation between a first central axis of the first counter-roller and the first rotation axis of the first drive roller and/or the relative orientation between a second central axis of the second counter-roller and the second rotation axis of the second drive roller.

16. Method according to claim 15, wherein the second drive roller and the second counter-roller are arranged downstream of the first drive roller and the first counter-roller along the web advancement path;

wherein during the step of controlling and/or modifying, the orientation of the second central axis is controlled and/or modified with respect to the second rotation axis for controlling an advancement direction and/or the orientation and/or the alignment of the web of packaging material.

* * * * *